US009651043B2

(12) United States Patent
Stover et al.

(10) Patent No.: US 9,651,043 B2
(45) Date of Patent: May 16, 2017

(54) COMPRESSOR VALVE SYSTEM AND ASSEMBLY

(71) Applicant: Emerson Climate Technologies, Inc., Sidney, OH (US)

(72) Inventors: Robert C. Stover, Versailles, OH (US); Ronald E. Bonear, Troy, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 421 days.

(21) Appl. No.: 14/060,102

(22) Filed: Oct. 22, 2013

(65) Prior Publication Data

US 2014/0134030 A1 May 15, 2014

Related U.S. Application Data

(60) Provisional application No. 61/726,814, filed on Nov. 15, 2012.

(51) Int. Cl.
*F04C 14/12* (2006.01)
*F04C 18/02* (2006.01)
(Continued)

(52) U.S. Cl.
CPC ..... *F04C 18/0207* (2013.01); *F04C 18/0215* (2013.01); *F04C 18/0253* (2013.01);
(Continued)

(58) Field of Classification Search
CPC ..... F04C 18/0207; F04C 18/0215; F04C 18/0253; F04C 23/008; F04C 28/12;
(Continued)

(56) References Cited

U.S. PATENT DOCUMENTS 4,058,988 A 11/1977 Shaw
4,216,661 A 8/1980 Tojo et al.
(Continued)

FOREIGN PATENT DOCUMENTS

CN 1158944 A 9/1997
CN 1158945 A 9/1997
(Continued)

OTHER PUBLICATIONS

China Office Action regarding Application No. 201080020243.1 dated Nov. 5, 2013. Translation provided by Unitalen Attorneys At Law.

(Continued)

*Primary Examiner* — Dominick L Plakkoottam
(74) *Attorney, Agent, or Firm* — Harness, Dickey & Pierce, P.L.C.

(57) ABSTRACT

A compressor may include first and second scroll members having first and second scroll wraps, respectively. The scroll members define a suction inlet, a discharge outlet, and fluid pockets moving therebetween. The second scroll member may include a port, and a passage. The port may be in fluid communication with at least one of the pockets. The passage may extend through a portion of the second end plate and may be in fluid communication with the port. A valve assembly may be disposed in the passage and may include a valve member displaceable between open and closed positions. A recompression volume may be disposed between the valve member and the at least one of the pockets. The recompression volume may be less than or equal to approximately one percent of a volume of one of the pockets at a suction seal-off position.

9 Claims, 8 Drawing Sheets

(51) Int. Cl.
*F04C 28/12* (2006.01)
*F04C 29/12* (2006.01)
*F04C 23/00* (2006.01)

(52) U.S. Cl.
CPC ..... *F04C 18/0292* (2013.01); *F04C 28/12* (2013.01); *F04C 29/124* (2013.01); *F04C 23/008* (2013.01)

(58) Field of Classification Search
CPC ..... F04C 29/124; F04C 18/02; F04C 27/005; F04C 29/042; F04C 29/126; F04C 29/128; F04C 18/0223; F04C 18/0261; F04C 18/0292; F01C 1/0207; F01C 1/0215; F01C 1/02; F01C 1/0223; F01C 19/08
USPC ..... 418/55.1–55.5; 417/410.5
See application file for complete search history.

(56) References Cited

U.S. PATENT DOCUMENTS 4,382,370 A 5/1983 Suefuji et al.
4,383,805 A 5/1983 Teegarden et al.
4,389,171 A 6/1983 Eber et al.
4,475,360 A 10/1984 Suefuji et al.
4,497,615 A 2/1985 Griffith
4,545,742 A 10/1985 Schaefer
4,609,329 A 9/1986 Pillis et al.
4,696,630 A 9/1987 Sakata et al.
4,727,725 A 3/1988 Nagata et al.
4,774,816 A 10/1988 Uchikawa et al.
4,818,195 A 4/1989 Murayama et al.
4,846,633 A 7/1989 Suzuki et al.
4,877,382 A 10/1989 Caillat et al.
4,886,425 A 12/1989 Itahana et al.
4,940,395 A 7/1990 Yamamoto et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
RE34,148 E 12/1992 Terauchi et al.
5,169,294 A 12/1992 Barito
5,192,195 A 3/1993 Iio et al.
5,193,987 A 3/1993 Iio et al.
5,240,389 A 8/1993 Oikawa et al.
5,253,489 A 10/1993 Yoshii
5,356,271 A 10/1994 Miura et al.
5,451,146 A 9/1995 Inagaki et al.
5,482,637 A 1/1996 Rao et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,607,288 A 3/1997 Wallis et al.
5,613,841 A 3/1997 Bass et al.
5,639,225 A 6/1997 Matsuda et al.
5,640,854 A 6/1997 Fogt et al.
5,674,058 A 10/1997 Matsuda et al.
5,678,985 A 10/1997 Brooke et al.
5,722,257 A 3/1998 Ishii et al.
5,741,120 A 4/1998 Bass et al.
5,855,475 A 1/1999 Fujio et al.
5,885,063 A 3/1999 Makino et al.
5,993,171 A 11/1999 Higashiyama
6,047,557 A 4/2000 Pham et al.
6,095,765 A 8/2000 Khalifa
6,102,671 A 8/2000 Yamamoto et al.
6,123,517 A 9/2000 Brooke et al.
6,132,179 A 10/2000 Higashiyama
6,139,287 A 10/2000 Kuroiwa et al.
6,149,401 A 11/2000 Iwanami et al.
6,164,940 A 12/2000 Terauchi et al.
6,176,686 B1 1/2001 Wallis et al.
6,179,589 B1 * 1/2001 Bass ..... F04C 23/008 137/543.19
6,202,438 B1 3/2001 Barito
6,210,120 B1 4/2001 Hugenroth et al.
6,213,731 B1 4/2001 Doepker et al.
6,231,316 B1 5/2001 Wakisaka et al.
6,273,691 B1 8/2001 Morimoto et al.
6,293,767 B1 9/2001 Bass
6,293,776 B1 9/2001 Hahn et al.
6,322,340 B1 11/2001 Itoh et al.
6,350,111 B1 2/2002 Perevozchikov et al.
6,379,123 B1 4/2002 Makino et al.
6,412,293 B1 7/2002 Pham et al.
6,413,058 B1 7/2002 Williams et al.
6,419,457 B1 7/2002 Seibel et al.
6,428,286 B1 8/2002 Shimizu et al.
6,454,551 B2 9/2002 Kuroki et al.
6,457,948 B1 10/2002 Pham
6,464,481 B2 10/2002 Tsubai et al.
6,478,550 B2 11/2002 Matsuba et al.
6,506,036 B2 1/2003 Tsubai et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,679,683 B2 1/2004 Seibel et al.
6,715,999 B2 4/2004 Ancel et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,893,229 B2 5/2005 Choi et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,118,358 B2 10/2006 Tsubono et al.
7,137,796 B2 11/2006 Tsubono et al.
7,160,088 B2 1/2007 Peyton
7,207,787 B2 4/2007 Liang et al.
7,229,261 B2 6/2007 Morimoto et al.
7,261,527 B2 8/2007 Alexander et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
RE40,400 E 6/2008 Bass et al.
7,393,190 B2 7/2008 Lee et al.
7,404,706 B2 7/2008 Ishikawa et al.
RE40,554 E 10/2008 Bass et al.
7,547,202 B2 6/2009 Knapke
7,717,687 B2 5/2010 Reinhart
7,771,178 B2 8/2010 Perevozchikov et al.
RE42,371 E 5/2011 Peyton
7,967,582 B2 6/2011 Akei et al.
7,967,583 B2 6/2011 Stover et al.
7,972,125 B2 7/2011 Stover et al.
7,988,433 B2 8/2011 Akei et al.
8,025,492 B2 9/2011 Seibel et al.
8,506,271 B2 8/2013 Seibel et al.
8,616,014 B2 12/2013 Stover et al.
8,857,200 B2 10/2014 Stover et al.
9,127,677 B2 9/2015 Doepker
9,249,802 B2 2/2016 Doepker et al.
2001/0010800 A1 8/2001 Kohsokabe et al.
2002/0039540 A1 4/2002 Kuroki et al.
2003/0044296 A1 * 3/2003 Chen ..... F04C 29/126 418/55.1
2003/0186060 A1 10/2003 Rao
2004/0136854 A1 7/2004 Kimura et al.
2004/0146419 A1 7/2004 Kawaguchi et al.
2004/0184932 A1 9/2004 Lifson

(56) References Cited

U.S. PATENT DOCUMENTS

| | | | |
|---|---|---|---|
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0228243 | A1 | 10/2006 | Sun et al. |
| 2006/0233657 | A1 | 10/2006 | Bonear et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0159892 | A1 | 7/2008 | Huang et al. |
| 2008/0196445 | A1 | 8/2008 | Lifson et al. |
| 2008/0223057 | A1 | 9/2008 | Lifson et al. |
| 2008/0305270 | A1 | 12/2008 | Uhlianuk et al. |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0212311 | A1 | 8/2010 | McQuary et al. |
| 2010/0254841 | A1 | 10/2010 | Akei et al. |
| 2010/0300659 | A1* | 12/2010 | Stover ..... F04C 18/0215 165/104.31 |
| 2010/0303659 | A1 | 12/2010 | Stover et al. |
| 2011/0135509 | A1 | 6/2011 | Fields et al. |
| 2011/0206548 | A1 | 8/2011 | Doepker |
| 2011/0293456 | A1 | 12/2011 | Seibel et al. |
| 2013/0309118 | A1 | 11/2013 | Ginies et al. |
| 2014/0037486 | A1 | 2/2014 | Stover et al. |
| 2014/0154124 | A1 | 6/2014 | Doepker et al. |

FOREIGN PATENT DOCUMENTS

| | | | |
|---|---|---|---|
| CN | 1289011 | A | 3/2001 |
| CN | 1382912 | A | 12/2002 |
| CN | 1517553 | A | 8/2004 |
| CN | 1680720 | A | 10/2005 |
| CN | 1702328 | A | 11/2005 |
| CN | 1963214 | A | 5/2007 |
| CN | 1995756 | A | 7/2007 |
| CN | 101761479 | A | 6/2010 |
| CN | 101806302 | A | 8/2010 |
| CN | 101910637 | A | 12/2010 |
| CN | 102076963 | A | 5/2011 |
| CN | 102449314 | A | 5/2012 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| JP | 60259794 | | 12/1985 |
| JP | 03081588 | A | 4/1991 |
| JP | H07-293456 | A | 11/1995 |
| JP | 08334094 | A | 12/1996 |
| JP | H09-177689 | A | 7/1997 |
| JP | 11107950 | | 4/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 2003074481 | A | 3/2003 |
| JP | 2003074482 | A | 3/2003 |
| JP | 2003106258 | A | 4/2003 |
| JP | 2003227479 | A | 8/2003 |
| JP | 2007154761 | A | 6/2007 |
| JP | 2008248775 | A | 10/2008 |
| KR | 101987000001 | | 5/1985 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101192642 | B1 | 10/2012 |
| WO | WO-0073659 | A1 | 12/2000 |
| WO | WO-2007046810 | A2 | 4/2007 |
| WO | WO-2009155099 | A2 | 12/2009 |
| WO | WO-2010118140 | A2 | 10/2010 |

OTHER PUBLICATIONS

International Search Report regarding Application No. PCT/US2013/069462, mailed Feb. 21, 2014.

Written Opinion of the Internation Searching Authority regarding Application No. PCT/US2013/069462, mailed Feb. 21, 2014.

Search Report regarding European Patent Application No. 10762374.6-1608 / 2417356 PCT/US2010030248, dated Jun. 16, 2015.

International Search Report regarding Application No. PCT/US2013/070981, mailed Mar. 4, 2014.

Written Opinion of the International Searching Authority regarding Application No. PCT/US2013/070981, mailed Mar. 4, 2014.

International Search Report regarding Application No. PCT/US2013/069456, mailed Feb. 18, 2014.

Written Opinion of the International Searching Authority regarding Application No. PCT/US2013/069456, mailed Feb. 18, 2014.

International Search Report regarding Application No. PCT/US2013/070992, mailed Feb. 25, 2014.

Written Opinion of the International Searching Authority regarding Application No. PCT/US2013/070992, mailed Feb. 25, 2014.

U.S. Appl. No. 14/060,240, filed Oct. 22, 2013.

U.S. Office Action regarding U.S. Appl. No. 11/645,288 mailed Nov. 30, 2009.

Extended European Search Report regarding Application No. EP07254962 dated Mar. 12, 2008.

First China Office Action regarding Application No. 200710160038.5 dated Jul. 8, 2010.

China Office Action regarding Application No. 200710160038.5 dated Jan. 31, 2012.

International Search Report regarding Application No. PCT/US2011/025921, mailed Oct. 7, 2011.

Written Opinion of the International Search Authority regarding Application No. PCT/US2011/025921, mailed Oct. 7, 2011.

Written Opinion of the International Searching Authority regarding Application No. PCT/US2010/030248, mailed Nov. 26, 2010.

International Search Report regarding Application No. PCT/US2010/030248, mailed Nov. 26, 2010.

U.S. Office Action regarding U.S. Appl. No. 13/181,065 mailed Nov. 9, 2012.

U.S. Appl. No. 13/948,458, filed Jul. 23, 2013.

U.S. Appl. No. 13/948,653, filed Jul. 23, 2013.

U.S. Appl. No. 14/073,246, filed Nov. 6, 2013.

U.S. Appl. No. 14/073,293, filed Nov. 6, 2013.

International Search Report regarding Application No. PCT/US2013/051678, mailed Oct. 21, 2013.

Written Opinion of the International Searching Authority regarding Application No. PCT/US2013/051678, mailed Oct. 21, 2013.

Office Action regarding U.S. Appl. No. 14/060,240, dated Aug. 12, 2015.

International Search Report regarding International Application No. PCT/US2015/033960, dated Sep. 1, 2015.

Written Opinion of the International Searching Authority regarding International Application No. PCT/US2015/033960, dated Sep. 1, 2015.

Office Action regarding U.S. Appl. No. 14/294,458, dated Aug. 19, 2016.

(56) References Cited

OTHER PUBLICATIONS

Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Advisory Action regarding U.S. Appl. No. 14/073,293, dated Apr. 18, 2016.
First Office Action regarding Chinese application No. 201380059666.8, dated Apr. 5, 2016. Translation provided by Unitalen Attorneys At Law.
First Office Action regarding Chinese application No. 201380062614.6, dated Apr. 5, 2016. Translation provided by Unitalen Attorneys At Law.
Interview Summary regarding U.S. Appl. No. 14/060,240, mailed Dec. 1, 2015.
Office Action regarding Chinese Patent Application No. 201380059963.2, dated May 10, 2016. Translation provided by Unitalent Attorneys at Law.
Office Action regarding Chinese Patent Application No. 201380062657.4, dated May 4, 2016. Translation provided by Unitalen Attorneys at Law.
Office Action regarding Chinese Patent Application No. 201410460792.0, dated Feb. 25, 2016. Translation provided by Unitalen Attorneys at Law.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Office Action regarding U.S. Appl. No. 14/073,293, dated Sep. 25, 2015.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.

* cited by examiner

COMPRESSOR VALVE SYSTEM AND ASSEMBLY

CROSS-REFERENCE TO RELATED APPLICATIONS

This application claims the benefit of U.S. Provisional Application No. 61/726,814, filed on Nov. 15, 2012. The entire disclosure of the above application is incorporated herein by reference.

FIELD

The present disclosure relates to a compressor, and more particularly to a compressor valve system and assembly.

BACKGROUND

This section provides background information related to the present disclosure and is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. Efficient and reliable operation of the compressor is desirable to ensure that the cooling, refrigeration, or heat-pump system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a first scroll member, a second scroll member, and a valve assembly. The first scroll member includes a first scroll wrap extending from a first end plate. The second scroll member may include a second scroll wrap extending from a second end plate, a port, and a passage. The second scroll wrap is intermeshed with the first scroll wrap. The first and second scroll members define a suction inlet, a discharge outlet, and fluid pockets moving therebetween. The port may be in fluid communication with at least one of the pockets. The passage may extend through a portion of the second end plate and may be in fluid communication with the port and a fluid region. The valve assembly may be disposed in the passage and may include a valve member displaceable between open and closed positions. A recompression volume may be disposed between the valve member and the at least one of the pockets. The recompression volume may be less than or equal to approximately one percent of a volume of one of the pockets at a suction seal-off position.

In some embodiments, the recompression volume may be less than or equal to approximately three-hundredths (0.03) percent of the volume of the one of the pockets at the suction seal-off position.

In some embodiments, the recompression volume may be less than or equal to approximately one-half (0.5) percent of the volume of the one of the pockets at the suction seal-off position.

In some embodiments, the compressor may include a discharge passage extending axially through the first end plate and in fluid communication with the passage. The discharge passage may be in fluid communication with the port when the valve member is in the open position.

In some embodiments, the valve member may include a first portion slidably engaging the passage and a second portion having a smaller diameter than the first portion and forming a leakage path around the valve member to allow fluid communication between the port and the discharge passage when the valve member is in the open position.

In some embodiments, the valve member may include a tapered portion extending into the port when the valve member is in the closed position.

In some embodiments, the valve assembly may include a valve body fixed within the passage and a spring disposed axially between the valve body and the valve member and biasing the valve member toward a closed position.

In some embodiments, the valve body may include an axially extending stem located within a recess in the valve member. The valve member may be axially displaceable along the stem between the open and closed positions.

In some embodiments, the compressor may include a wear washer disposed axially between the valve member and the spring.

In some embodiments, the valve assembly may include a valve body slidably receiving the valve member and having an aperture disposed directly adjacent the port and the valve member to reduce the recompression volume.

In some embodiments, the passage may include a radially extending bore in fluid communication with a fluid-injection source.

In some embodiments, the passage may engage a fluid-injection fitting extending through a shell of the compressor.

In some embodiments, the valve assembly may include a valve body having a first inner portion and a second inner portion in fluid communication with the passage. The first inner portion may include a larger diameter than the second inner portion and slidably receiving the valve member. The second inner portion may be in fluid communication with the port when the valve member is in the open position.

In some embodiments, the valve member may include a tapered end portion engaging a tapered valve seat disposed between the first and second inner portions.

In some embodiments, the valve body may include an aperture extending through the first inner portion and an outer portion of the valve body. The valve member may include an outer portion disposed directly adjacent to the aperture to reduce the recompression volume.

In some embodiments, the valve assembly may include a valve cap engaging the passage and partially defining the recompression volume.

In some embodiments, the valve cap may include a stem portion received within the first inner portion.

In some embodiments, the valve assembly may include a spring and a wear washer disposed axially between the spring and the valve member. The spring may bias the valve member toward the closed position.

In some embodiments, the compressor may include a hollow fastener engaging the passage and disposed adjacent to and radially outward from the valve body. The hollow fastener may retain the valve body in a fixed location relative to the passage.

In another form, the present disclosure provides a compressor that may include a first scroll member, a second scroll member, and a valve member. The first scroll member includes a first scroll wrap extending from a first end plate. The second scroll member may include a second scroll wrap extending from a second end plate, a discharge passage, a port, and an axial passage. The second scroll wrap is intermeshed with the first scroll wrap. The first and second scroll members define a suction inlet, a discharge outlet, and fluid pockets moving therebetween. The discharge passage may extend through the second end plate and may be in communication said discharge outlet. The port may be in fluid communication with at least one of the pockets. The axial passage may be in fluid communication with the port and the discharge passage. The valve member may be displaceable between open and closed positions and may cooperate with the at least one of the pockets to provide a recompression volume that is less than or equal to approximately one percent of a volume of one of the pockets at a suction seal-off position.

In some embodiments, the valve member may include a tip portion, a first outer portion slidably engaging the axial passage, and a second outer portion disposed between the tip portion and the first outer portion. The second outer portion may include a smaller diameter than the first outer portion and may form a leakage path around the valve member to allow fluid communication between the port and the discharge passage when the valve member is in the open position.

In some embodiments, the recompression volume may be less than or equal to approximately three-hundredths (0.03) percent of the volume of the one of the fluid pockets at the suction seal-off position.

In some embodiments, the valve member may include a tip portion engaging a valve seat directly adjacent to the port when the valve member is in the closed position.

In some embodiments, the tip portion may be tapered and may extend into the port when the valve member is in the closed position.

In some embodiments, the compressor may include a valve body fixed within the axial passage and a spring disposed axially between the valve body and the valve member and biasing the valve member into the closed position.

In some embodiments, the valve body may include an axially extending stem located within a recess in the valve member. The valve member may be axially displaceable along the stem between the open and closed positions.

In some embodiments, the compressor may include a wear washer disposed axially between the valve member and the spring.

In yet another form, the present disclosure provides a compressor that may include a first scroll member, a second scroll member, and a valve assembly. The first scroll member includes a first scroll wrap extending from a first end plate. The second scroll member may include a second scroll wrap extending from a second end plate, a port, and a passage. The second scroll wrap is intermeshed with the first scroll wrap. The first and second scroll members define a suction inlet, a discharge outlet, and fluid pockets moving therebetween. The port may be in fluid communication with at least one of the pockets. The passage may extend radially through a portion of the second end plate and may be in fluid communication with the port and a fluid-injection source. The valve assembly may be disposed in the passage and may include a valve body and a valve member. A recompression volume may be disposed between the valve member and the at least one of said pockets. The recompression volume may be less than or equal to approximately one percent of a volume of one of the pockets at a suction seal-off position.

In some embodiments, the recompression volume may be less than or equal to approximately one-half (0.5) percent of the volume of the one of the pockets at the suction seal-off position.

In some embodiments, the valve body may be directly adjacent to the port.

In some embodiments, the valve body may include a first inner portion and a second inner portion in fluid communication with the passage. The first inner portion may include a larger diameter than the second inner portion and may slidably receive the valve member. The second inner portion may be in fluid communication with the port when the valve member is in the open position.

In some embodiments, the valve body may include an aperture extending through an outer portion of the valve body and the first inner portion. The valve member may include an outer portion disposed directly adjacent to the aperture.

In some embodiments, the valve assembly may include a valve cap engaging the passage and the first inner portion of the valve body.

In some embodiments, the valve cap may include a stem portion received within the first inner portion.

In some embodiments, the valve assembly may include a spring and a wear washer disposed axially between the spring and the valve member. The spring may bias the valve member toward the closed position.

In some embodiments, the compressor may include a hollow fastener engaging the passage and disposed adjacent to and radially outward from the valve body. The hollow fastener may retain the valve body in a fixed location relative to the passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
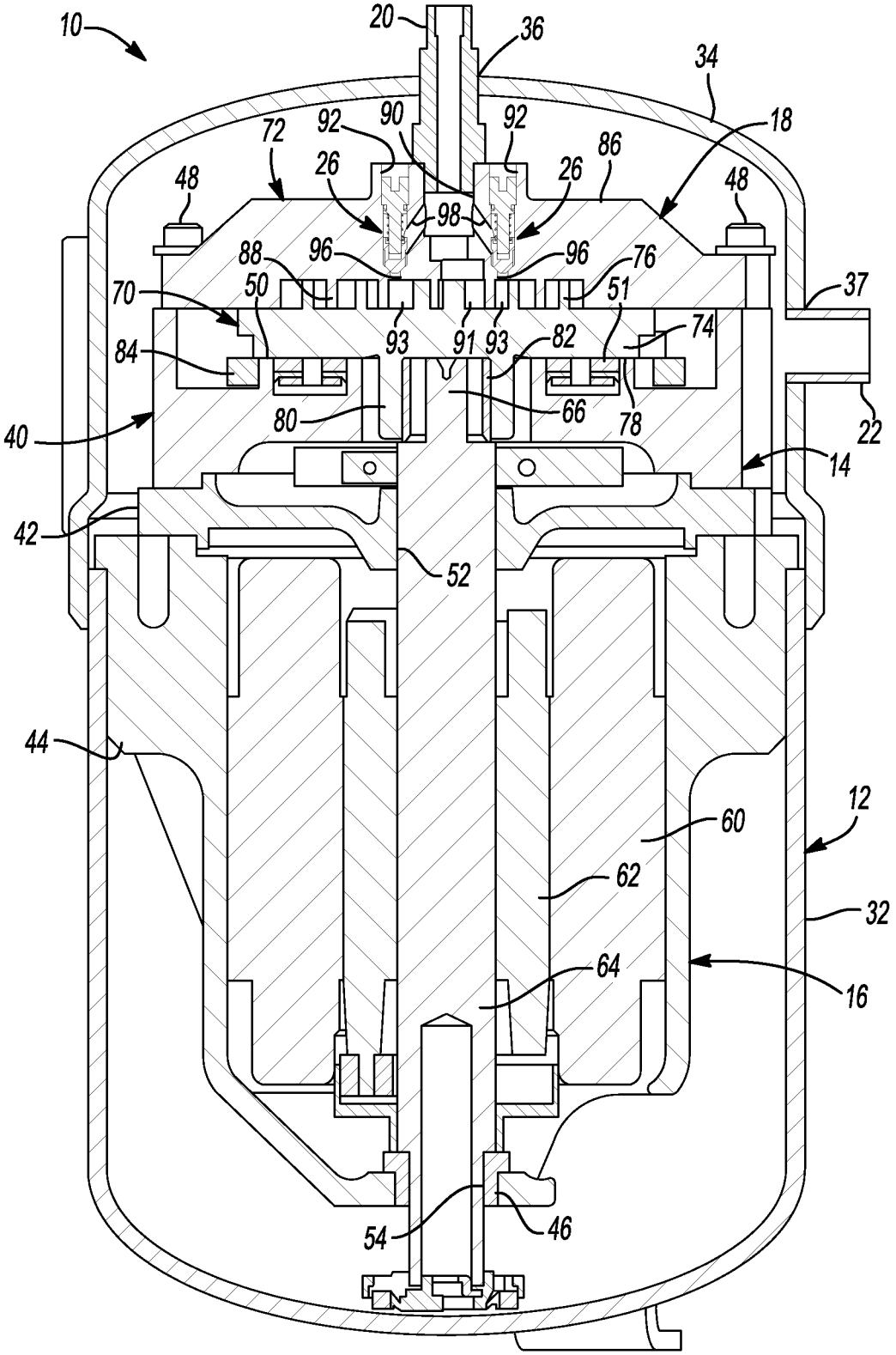
FIG. 1 is a cross-sectional view of a compressor according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
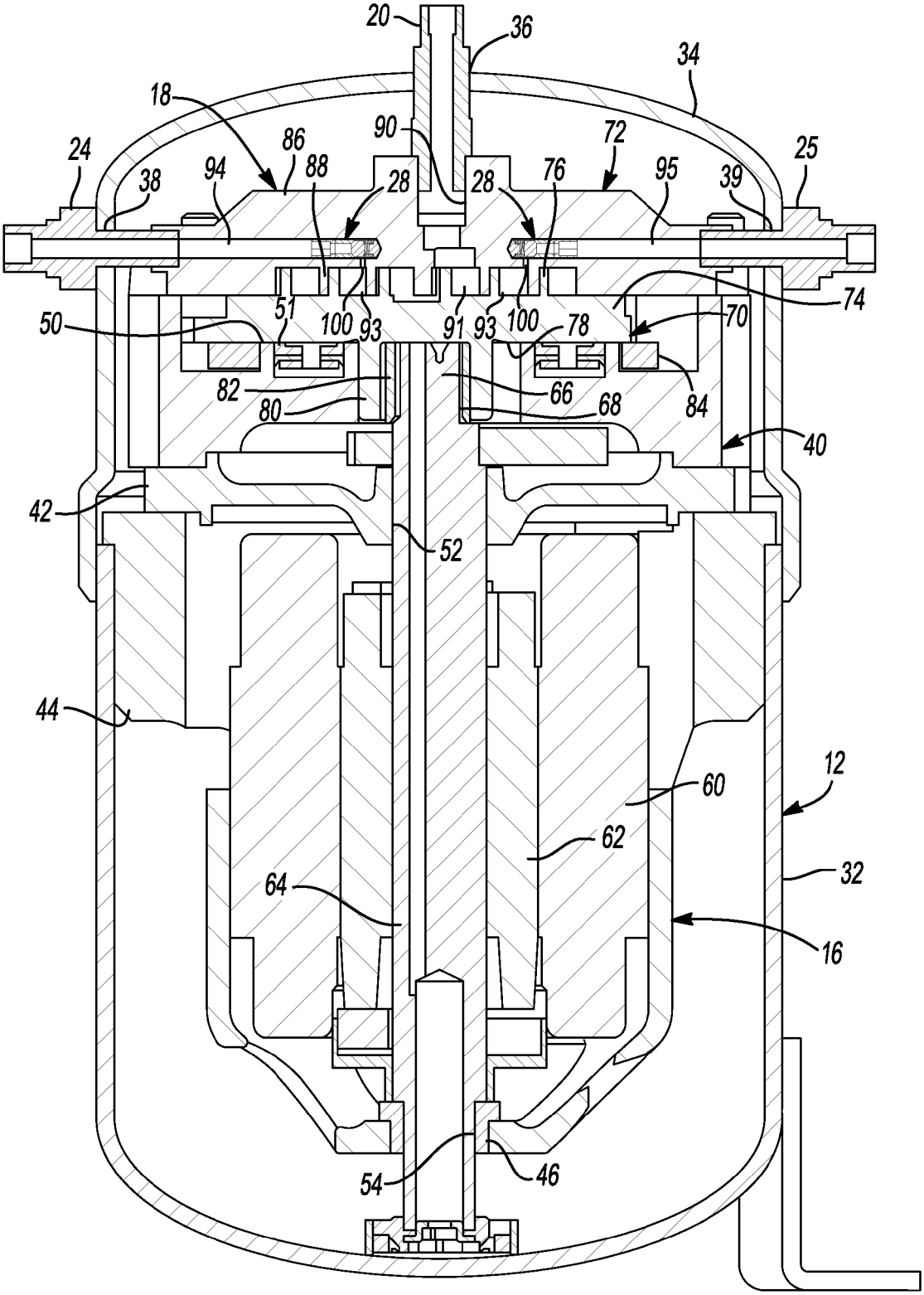
FIG. 2 is an additional cross-sectional view of the compressor of FIG. 1.

With reference to FIGS. 1 and 2, a compressor 10 is provided and may include a hermetic shell assembly 12, a bearing assembly 14, a motor assembly 16, a compression mechanism 18, a discharge fitting 20, a suction fitting 22 (FIG. 1), first and second fluid-injection fittings 24, 25 (FIG. 2), a plurality of first valve assemblies 26 (FIG. 1), and a plurality of second valve assemblies 28 (FIG. 2). The compressor 10 may circulate fluid throughout a fluid circuit of a heat pump or climate control system 30 (FIG. 11), for example.

The shell assembly 12 may house the bearing assembly 14, the motor assembly 16, and the compression mechanism 18. The shell assembly 12 may generally form a compressor housing and may include a cylindrical shell 32 and an end cap 34 at the upper end thereof. The discharge fitting 20 is attached to the shell assembly 12 at an opening 36 in the end cap 34. A discharge valve assembly (not shown) may be in communication with the discharge fitting 20 to prevent a reverse flow condition. The suction fitting 22 is attached to the shell assembly 12 at an opening 37 (FIG. 1). The first and second fluid-injection fittings 24, 25 may be attached to the shell assembly 12 at first and second openings 38, 39 (FIG. 2), respectively.

The bearing assembly 14 may include a first bearing housing member 40, a first bearing 42, a second bearing housing member 44, and a second bearing 46. The second bearing housing member 44 may be fixed to the shell 32 at one or more points in any desirable manner, such as staking, welding, and/or via fasteners, for example. The first bearing housing member 40 and the first bearing 42 may be fixed relative to the second bearing housing member 44 via fasteners 48. The first bearing housing member 40 may be an annular member including a thrust bearing surface 50 on an axial end surface thereof. The first bearing 42 may be disposed between the first and second bearing housing members 40, 44 and includes a first annular bearing surface 52. The second bearing 46 may be supported by the second bearing housing member 44 and includes a second annular bearing surface 54.

The motor assembly 16 may generally include a motor stator 60, a rotor 62, and a drive shaft 64. The motor stator 60 may be press fit into the second bearing housing member 44 or the shell 32. The drive shaft 64 may be rotatably driven by the rotor 62. The rotor 62 may be press fit on the drive shaft 64 or otherwise fixed thereto. The drive shaft 64 may include an eccentric crank pin 66 having a flat 68 (FIG. 2) and may be supported for rotation by the first and second bearings 42, 46.

The compression mechanism 18 includes an orbiting scroll 70 and a non-orbiting scroll 72. The orbiting scroll 70 includes an end plate 74 having a spiral wrap 76 on the upper surface thereof and an annular thrust surface 78 on the lower surface. The thrust surface 78 may interface with the annular thrust bearing surface 50 on the first bearing housing member 40. In some embodiments, the thrust surface 78 may interface with an axial biasing member 51 rather than the bearing surface 50. A cylindrical hub 80 may project downwardly from the thrust surface 78 and may have a drive bushing 82 disposed therein. The drive bushing 82 may include an inner bore in which the crank pin 66 is disposed. The flat 68 on the crank pin 66 may drivingly engage a flat surface in a portion of the inner bore of the drive bushing 82 to provide a radially compliant driving arrangement. An Oldham coupling 84 may be engaged with the orbiting and non-orbiting scrolls 70, 72 to prevent relative rotation therebetween.

The non-orbiting scroll 72 may include an end plate 86 having a spiral wrap 88 on a lower surface thereof. A discharge passage 90 may extend through the end plate 86. A plurality of axial bores 92 (FIG. 1) may extend at least partially through the end plate 86 in an axial direction. First and second radial bores 94, 95 (FIG. 2) may extend radially through at least a portion of the end plate 86. The suction passage 99 (FIGS. 7 and 8) may extend through the end plate 86 in an axial direction and is in fluid communication with the suction fitting 22. The suction passage 99 may be alternatively shaped and/or configured, such as extending radially through the non-orbiting scroll 72, for example.

The spiral wrap 88 meshingly engages the spiral wrap 76 of the orbiting scroll 70, thereby defining a suction inlet 89 at a radially outer position, a discharge outlet 91 at a radially inner position, and fluid pockets moving between the suction inlet 89 and the discharge outlet 91. The suction inlet 89 may be in fluid communication with the suction fitting 22 via the suction passage 99, and the discharge outlet 91 may be in fluid communication with the discharge passage 90. The pockets defined by the spiral wraps 76, 88 decrease in volume as they move between the radially outer position to the radially inner position throughout a compression cycle of the compression mechanism 18. More specifically, the pockets may decrease in volume from a suction seal-off (initial) position to a discharge (final) position.

The compressor 10 may include a built-in volume ratio (BVR), which is defined as the ratio of fluid volume trapped at the suction seal-off position (i.e., a suction volume defined as the volume of fluid drawn into the compression mechanism 18 at the radially outermost position at which the fluid pockets are sealed by the orbiting and non-orbiting scrolls 70, 72 (FIG. 7)) to the fluid volume at the discharge position or the onset of discharge opening (i.e., the discharge volume). A system pressure ratio of the climate control system 30 is the ratio of the pressure of the fluid drawn into the compressor 10 at the suction fitting 22 to the pressure of the fluid discharged from the compressor 10 at the discharge fitting 20. The pressures at the discharge and suction fittings 20, 22 are at least partially affected by operating conditions throughout the rest of the climate control system 30.

An internal compressor-pressure ratio of the compressor 10 may be defined as a ratio of a pressure of the fluid trapped at suction seal-off to a pressure of the fluid at the discharge position or at the onset of discharge opening. The internal compressor-pressure ratio may be determined by parameters such as the BVR, properties of a selected working fluid, and one or more system operating conditions, for example. For example, internal compressor-pressure ratio may be determined by an adiabatic coefficient, which may be dependent upon one or more system operating conditions.

Over-compression is a condition where the internal compressor-pressure ratio is higher than the system pressure ratio. In an over-compression condition, the compression mechanism 18 is compressing fluid to a pressure higher than the pressure at the discharge fitting 20. Accordingly, in an over-compression condition, the compressor 10 is performing unnecessary work, which reduces the efficiency of the compressor.

Figure 3:
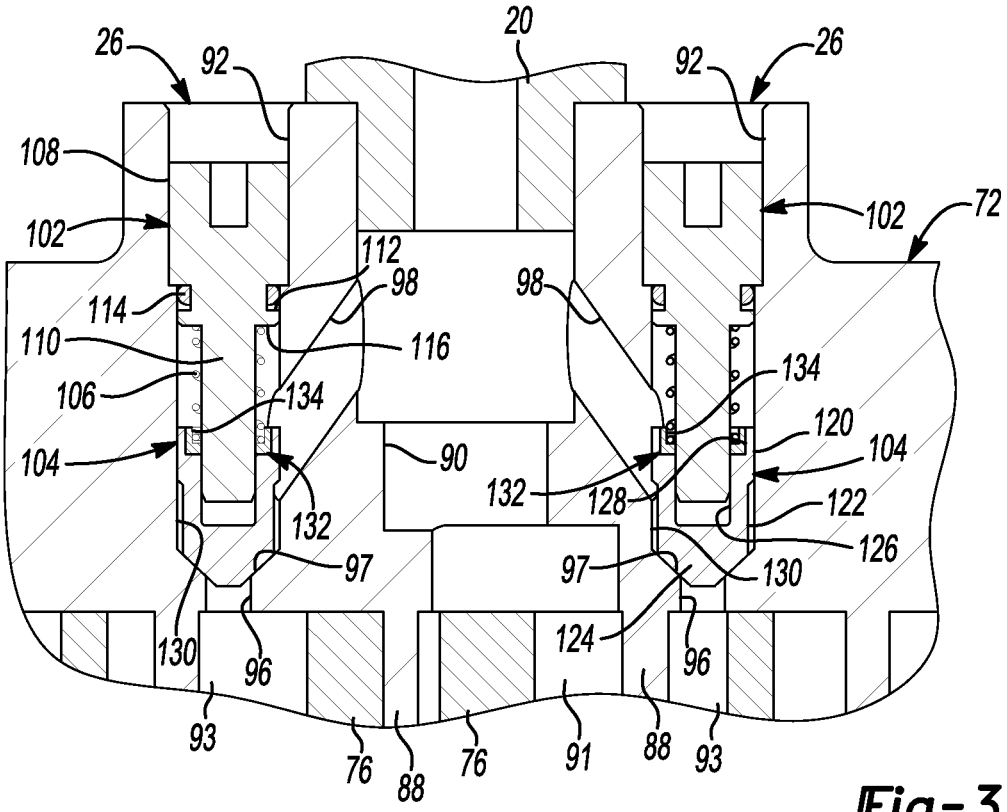
FIG. 3 is a partial cross-sectional view of a non-orbiting scroll member including a plurality of first valve assemblies in closed positions according to the principles of the present disclosure.
Figure 4:
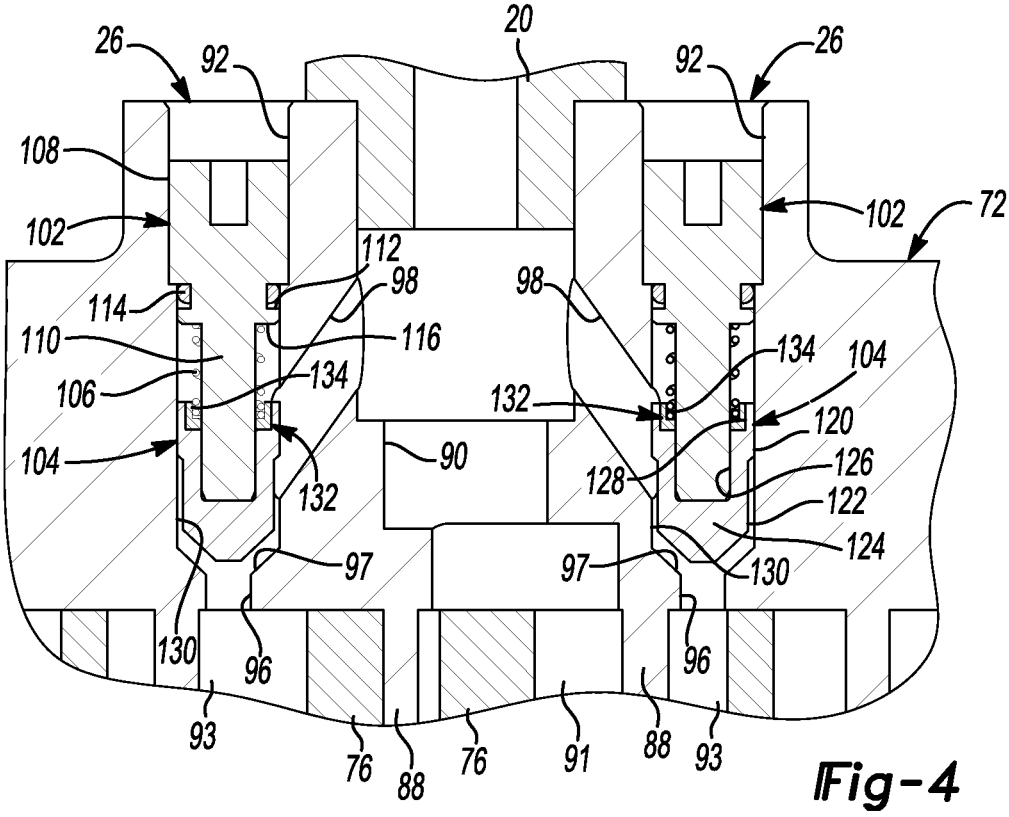
FIG. 4 is a partial cross-sectional view of the non-orbiting scroll member including the plurality of first valve assemblies in open positions according to the principles of the present disclosure.
Figure 5:
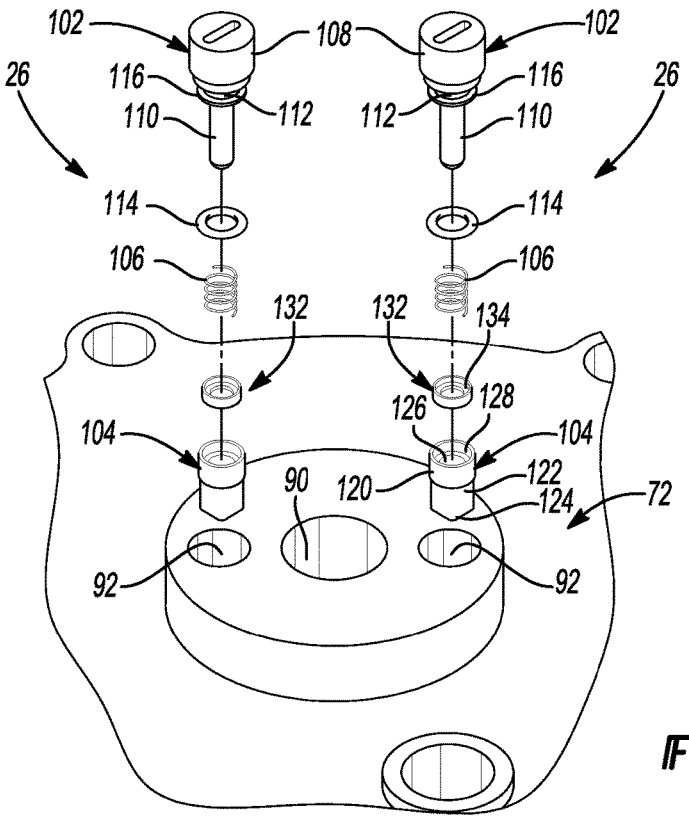
FIG. 5 is an exploded perspective view of the valve assemblies of FIG. 3.

As shown in FIGS. 1, 3, and 4, the axial bores 92 selectively communicate with at least one of the moving fluid pockets 93 that may be in radially intermediate positions (i.e., between the radially outer position and the radially inner position) via ports 96 in the lower surface of the end plate 86. Fluid within the fluid pockets 93 may be at an intermediate pressure that is greater than a suction pressure at the suction fitting 22 and less than a discharge pressure at the discharge fitting 20. Each of the axial bores 92 may include a tapered valve seat 97 adjacent to the ports 96. The axial bores 92 are in communication with a fluid region, such as the discharge passage 90, via passages 98.

Figure 7:
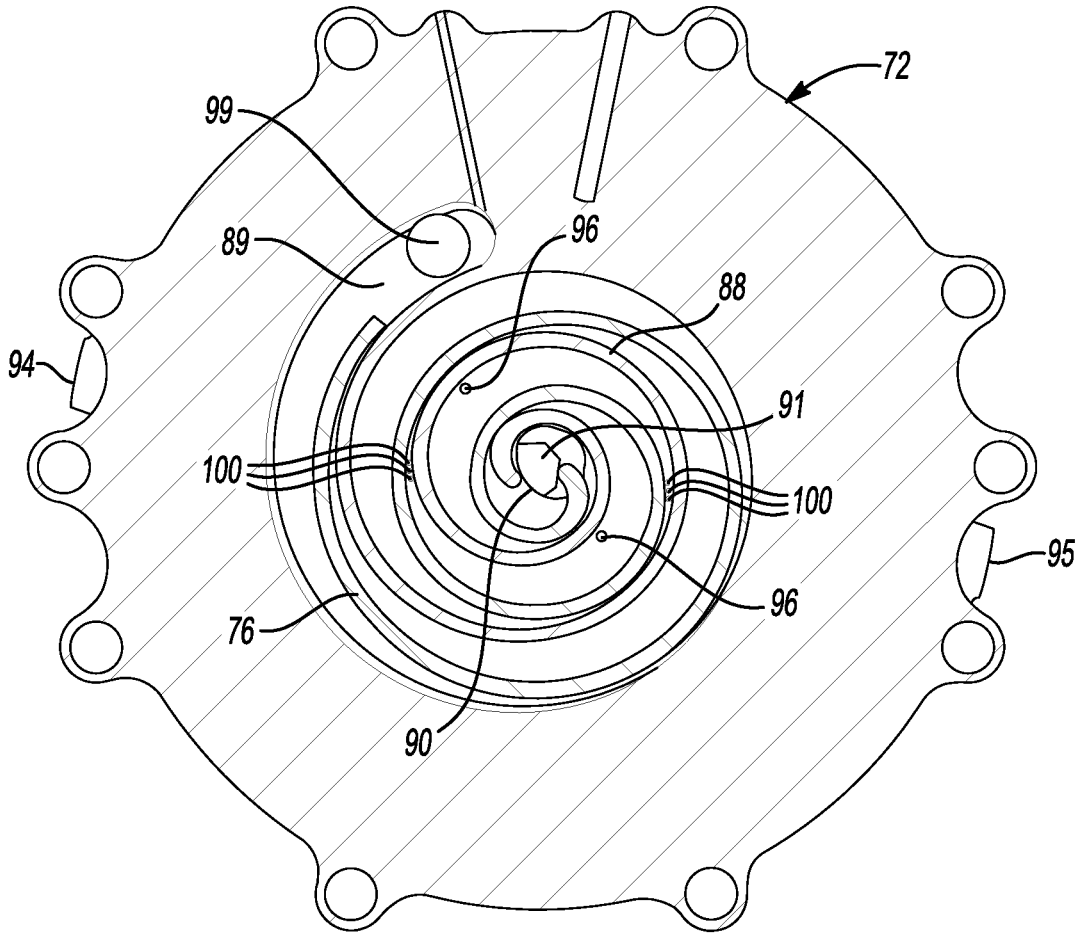
FIG. 7 is a partial cross-sectional view of the non-orbiting scroll member engaging an orbiting scroll wrap.
Figure 8:
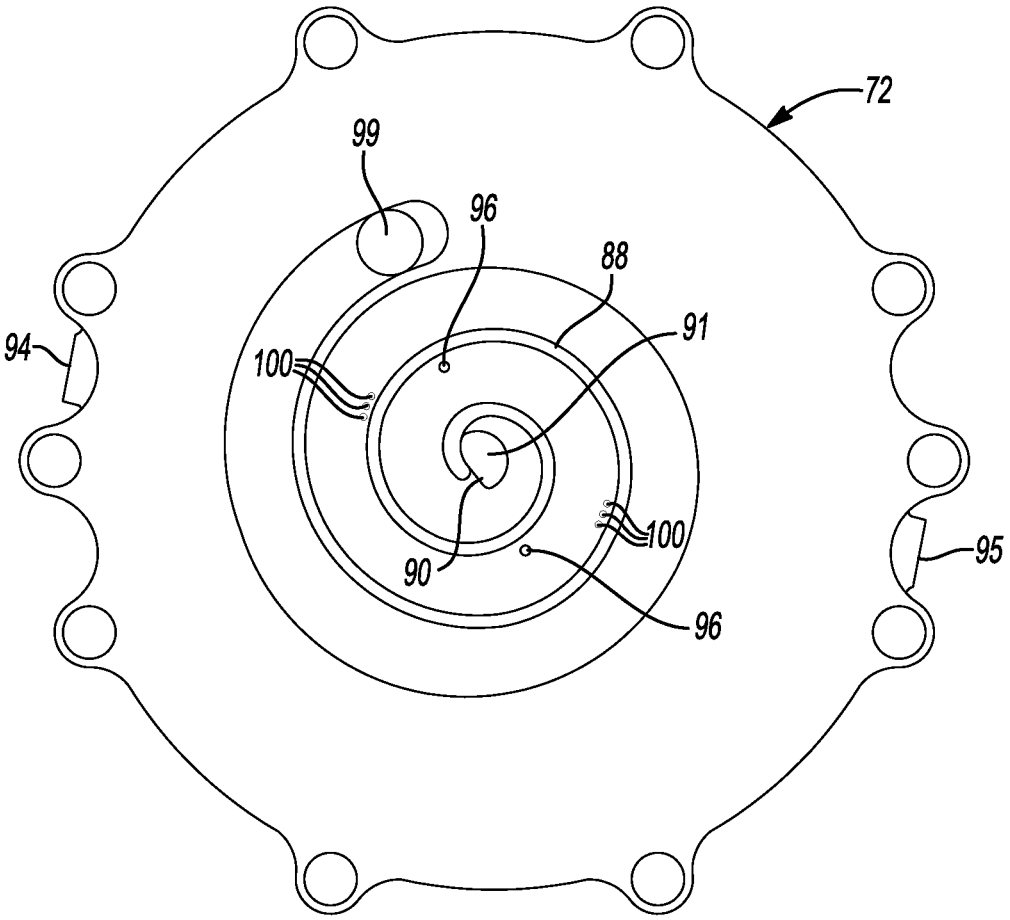
FIG. 8 is a plan view of the non-orbiting scroll member having a plurality of fluid-injection ports according to the principles of the present disclosure.
Figure 9:
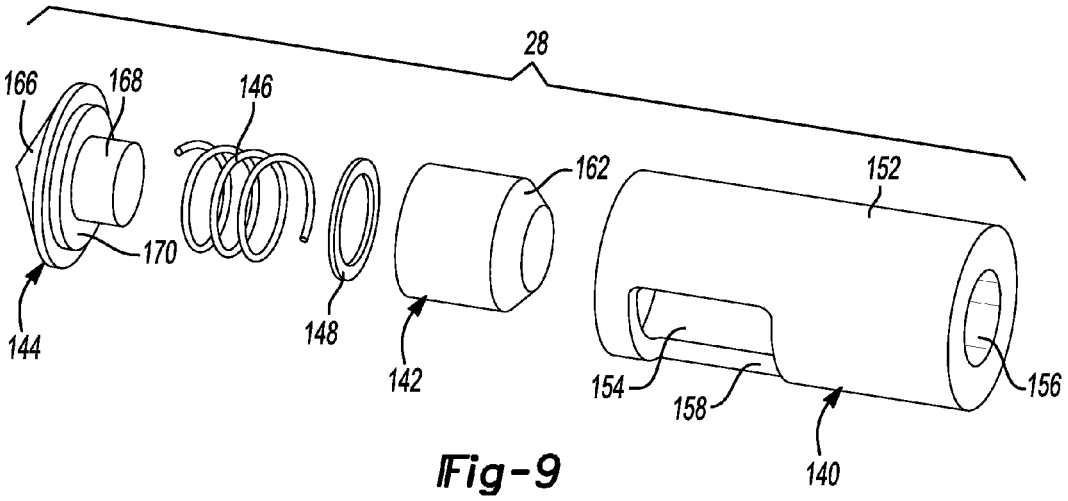
FIG. 9 is an exploded perspective view of the fluid-injection valve assembly of FIG. 6.

As shown in FIG. 2, the first and second radial bores 94, 95 are in communication with the first and second fluid-injection fittings 24, 25, respectively. Each of the first and second radial bores 94, 95 may be in communication with one or more fluid-injection ports 100 and a fluid region, such as a fluid-injection source. The fluid-injection ports 100 may extend axially through a lower portion of the end plate 86 and are in selective communication with the fluid pockets 93 disposed between the radially outer position and the radially inner position. As shown in FIGS. 7 and 8, the non-orbiting scroll 72 may include a plurality of fluid-injection ports 100 in communication with each of the first and second radial bores 94, 95.

Referring now to FIGS. 1 and 3-5, the first valve assemblies 26 may be disposed in the axial bores 92 and may selectively allow and prevent communication between corresponding ports 96 and passages 98, as will be subsequently described. Each of the first valve assemblies 26 may include a body 102, a movable valve member 104, and a resiliently compressible member 106. The valve member 104 may be movable within the axial bore 92 relative to the body 102 between a closed position (FIG. 3) to prevent communication between the port 96 and the discharge passage 90 and an open position (FIG. 4) to allow communication between the port 96 and the discharge passage 90. While the particular embodiment shown in FIGS. 1 and 3-5 includes two first valve assemblies 26 and two ports 96, the compressor 10 could include any number of first valve assemblies 26 and ports 96.

The body 102 may be formed from a metallic or polymeric material, for example, and may include a plug portion 108 and a stem portion 110. The plug portion 108 may be a generally cylindrical member threadably engaged, press fit or otherwise engaged with the corresponding axial bore 92 and may include an annular groove 112. An O-ring 114 or other sealing member may be seated in the annular groove 112 to provide a more robust seal between the body 102 and the axial bore 92. The stem portion 110 may extend axially from the plug portion toward the orbiting scroll 70. The plug portion 108 and the stem portion 110 may cooperate to define an annular shoulder 116.

The valve member 104 may include a first portion 120 defining a first outer diameter, a second portion 122 defining a second outer diameter, a tapered tip 124, an axially extending recess 126, and an annular recess 128. The first outer diameter may be greater than the second outer diameter. The first portion 120 may be slidably engaged with the axial bore 92. The second portion 122 and the axial bore 92 may cooperate to form a leakage path 130 therebetween. The tapered tip 124 may sealingly engage the valve seat 97 of the axial bore 92. The axially extending recess 126 may slidably receive the stem portion 110 of the body 102.

An annular wear washer 132 may be received in the annular recess 128 of the valve member 104 and may be fixed relative thereto. The wear washer 132 may include an annular shoulder 134. The wear washer 132 may be formed from a metallic or polymeric material and may protect the valve member 104 from wear.

The resiliently compressible member 106 may be a coil spring, for example, and may be disposed around the stem portion 110 between the annular shoulder 116 of the body 102 and the annular shoulder 134 of the wear washer 132. The compressible member 106 biases the valve member 104 toward the closed position (FIG. 3).

The close proximity of the tip 124 of the valve member 104 to the fluid pocket 93 creates a volume of fluid trapped in the port 96 between the valve member 104 and the fluid pocket 93 of less than or equal to approximately one percent of the suction volume of the compression mechanism 18. The suction volume may generally be defined as the volume within the radial outermost pockets at suction seal-off. The volume of fluid trapped in the port 96 between the valve member 104 and the fluid pocket 93 (i.e., the volume defined by the tip 124 of the valve member 104 and the fluid pocket 93) may be referred to as a recompression volume and may have a minimal or negligible impact on the efficiency of the compressor 10. In some embodiments, the recompression volume may be approximately 0.1% or less than the suction volume. In some embodiments, the recompression volume may be approximately 0.03% or less than the suction volume.

Referring now to FIGS. 6-10, the second valve assemblies 28 may be disposed in respective first and second radial bores 94, 95 and may selectively allow and prevent communication between corresponding fluid-injection ports 100 and corresponding first and second fluid-injection fittings 24, 25, as will be subsequently described. Each of the plurality of second valve assemblies 28 may include a valve housing 140, a movable valve member 142, a cap 144, a resiliently compressible member 146, a wear washer 148, and a hollow fastener 150. The valve member 142 may be movable within the valve housing 140 relative to the cap 144 between a closed position to prevent communication between the fluid-injection port 100 and the corresponding fluid-injection fitting 24, 25 and an open position to allow communication between the fluid-injection port 100 and the corresponding fluid-injection fitting 24, 25.

The valve housing 140 may be a generally cylindrical member fixed within its corresponding radial bore 94, 95 and may include an outer surface 152 defining an outer diameter, an inner bore having a first portion 154 defining a first inner diameter and a second portion 156 defining a second inner diameter, and at least one aperture 158 extending through the first portion 154 and the outer surface 152. The first portion 154 may be greater than the second inner diameter. A tapered valve seat 160 may be disposed between the first and second portions 154, 156 and adjacent to the aperture 158. The aperture 158 may be generally aligned with the one or more fluid-injection ports 100 to allow fluid communication between the fluid pocket 93 and a space between the cap 144 and the valve member 142.

The valve member 142 may be a generally cylindrical member slidably engaging the first inner diameter 154 of the valve housing 140. The valve member 142 may include a tapered end portion 162 at a first end and a cylindrical boss 164 at a second end. The tapered end portion 162 may selectively sealingly engage the valve seat 160. The wear washer 148 may engage the boss 164 of the valve member 142 and protect the valve member 142 from wear.

The cap 144 may be attached to the valve housing 140 or otherwise fixed relative to the corresponding radial bore 94, 95 and may include a body portion 166 and a generally cylindrical stem portion 168. The body portion 166 may be disposed at a radially inner end of the radial bore 94, 95. The stem portion 168 may extend outward from the body portion 166 and may cooperate with the body portion 166 to define an annular shoulder 170.

The compressible member 146 may be a coil spring, for example, and may be disposed at least partially around the stem portion 168 and abut the shoulder 170 of the cap 144 at a first end and the wear washer 148 at a second end. The compressible member 146 may bias the valve member 142 toward the valve seat 160.

The hollow fastener 150 may be a generally tubular member fixedly engaging the radial bore 94, 95. The hollow fastener 150 may abut an end of the valve housing 140 and may be threadably engaged, press fit, adhesively bonded or otherwise fixed in place within the radial bore 94, 95 to secure the valve housing 140 and the cap 144 relative to the radial bore 94, 95.

Due to the close proximity of the valve member 142 to the fluid pocket 93 and the compact configuration of the second valve assemblies 28, the volume of fluid trapped between the valve member 142 and the fluid pocket 93 may be between 0.1% and 1.0%, and more specifically about 0.5% or less of the suction volume of the compression mechanism 18. The trapped volume may have a minimal or negligible impact on the efficiency of the compressor 10. As indicated above, the suction volume may generally be defined as the volume within the radial outermost pockets at suction seal-off.

Figure 10:
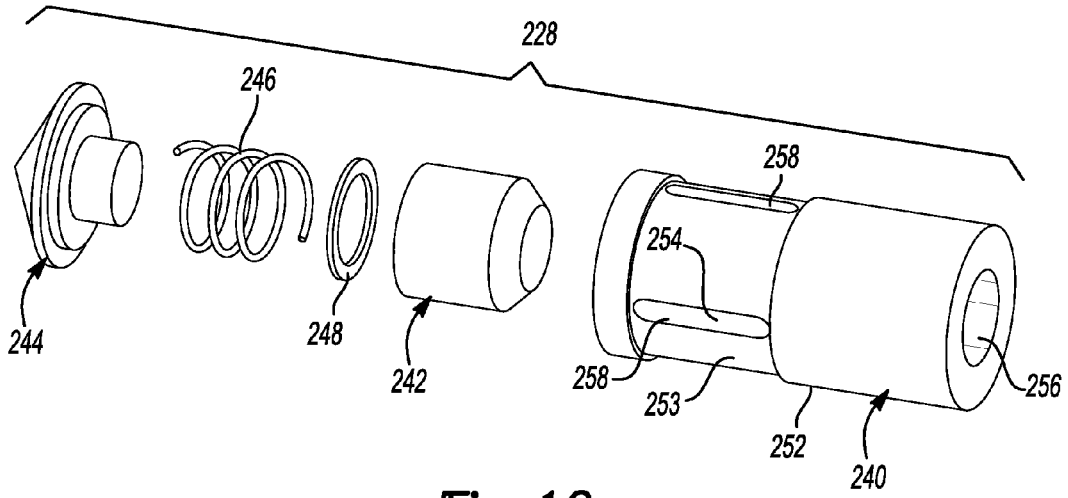
FIG. 10 is an exploded perspective view of another embodiment of the fluid-injection valve assembly according to the principles of the present disclosure.

Referring now to FIG. 10, another second valve assembly 228 is provided and may be generally similar to the second valve assembly 28, with the exception of valve housing 240. Valve member 242, cap 244, compressible member 246, and wear washer 248 may be similar to the valve member 142, cap 144, compressible member 146, and wear washer 148, respectively. The valve housing 240 may include the first and second inner portions 254, 256 that cooperate to form a valve seat (not shown) similar to the valve seat 160, an outer surface 252 defining a first outer diameter, and a recessed portion 253 defining a second outer diameter. The second outer diameter is a smaller diameter than the first outer diameter. A plurality of apertures 258 may extend through the recessed portion 253 and provide fluid communication between the first inner portion 254 and the one or more fluid-injection ports 100.

Figure 11:
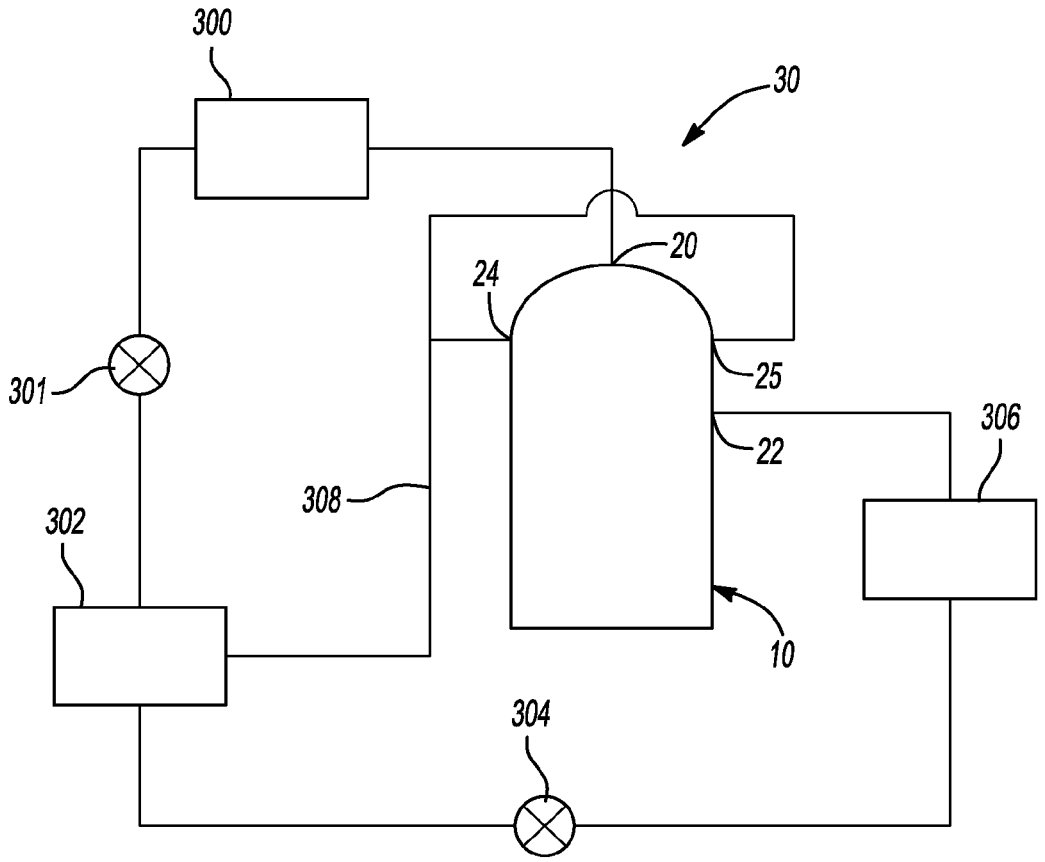
FIG. 11 is a schematic representation of a climate control system including the compressor of the present disclosure.

Referring now to FIG. 11, a climate control system 30 includes the compressor 10, a first heat exchanger 300, a first expansion device 301, a fluid-injection source 302, a second expansion device 304, and a second heat exchanger 306. The climate control system 30 may be a refrigeration system, a heating and/or cooling system or any other type of climate control system.

The fluid-injection source 302 may be a flash tank or plate heat exchanger, for example, and may be disposed between the first expansion device 301 and the second expansion device 304. The fluid-injection source 302 may include a conduit 308 in fluid communication with the radial bores 94, 95 via the first and second fluid-injection fittings 24, 25, respectively.

In a cooling mode, the first heat exchanger 300 may function as a condenser or a gas cooler, and the second heat exchanger 306 may function as an evaporator. In some embodiments the climate control system 30 may be a heat pump having a reversing valve (not shown) that may be operable to switch the climate control system 30 between the cooling mode and a heating mode. In the heating mode, the first heat exchanger 300 may function as an evaporator and the second heat exchanger 306 may function as a condenser or a gas cooler.

The second valve assemblies 28 of the present disclosure may eliminate a necessity for one or more external control valves regulating fluid communication between the fluid-injection source 302 and the compressor 10. However, in some embodiments, the climate control system 30 could include one or more external control valves in addition to the second valve assemblies 28.

With reference to FIGS. 1-11, during operation low-pressure fluid is received into the compressor 10 via the suction fitting 22 and is drawn into the compression mechanism 18, which forms moving fluid pockets, as described above. The fluid within the fluid pockets is compressed as it moves from the radially outer position to the radially inner position. Fluid is discharged from the compression mechanism 18 at a relatively high discharge pressure via the discharge passage 90 and exits the compressor 10 via the discharge fitting 20. The first and second pluralities of valve assemblies 26, 28 open and close to improve the efficiency of the compressor 10 while minimizing recompression losses.

Referring now to FIGS. 1, 3, and 4, the first valve assemblies 26 open and close in response to pressure differentials between the fluid pocket 93 and the discharge passage 90 to reduce or prevent over-compression. When the pressure of the fluid within the fluid pocket 93 is greater than the pressure of the fluid within the discharge passage 90, the pressure differential exerts a net force in a direction outward from valve seat 97 on the valve member 104. When the net force is sufficient to overcome the biasing force of the compressible member 106, the valve member 104 will move into the open position (FIG. 4). When the valve member 104 is in the open position, relatively high-pressure fluid is allowed to escape from the fluid pocket 93 through the port 96, around the valve member 104 via the leakage path 130, into the passage 98 and into the discharge passage 90. In this manner, the first valve assemblies 26 minimize or prevent over-compression of the fluid in the compression mechanism 18, thereby improving the efficiency of the compressor 10.

When the pressure within the fluid pocket 93 is at or below the pressure of the fluid within the discharge passage 90, the fluid pressure of the fluid within the discharge passage 90 and the compressible member 106 cooperate to exert a net force in a direction toward valve seat 97 on the valve member 104 causing the valve member 104 to move into the closed position (FIG. 3). In the closed position, the sealed relationship between the valve member 104 and the valve seat 97 prevents communication between the port 96 and the discharge passage 90.

Figure 6:
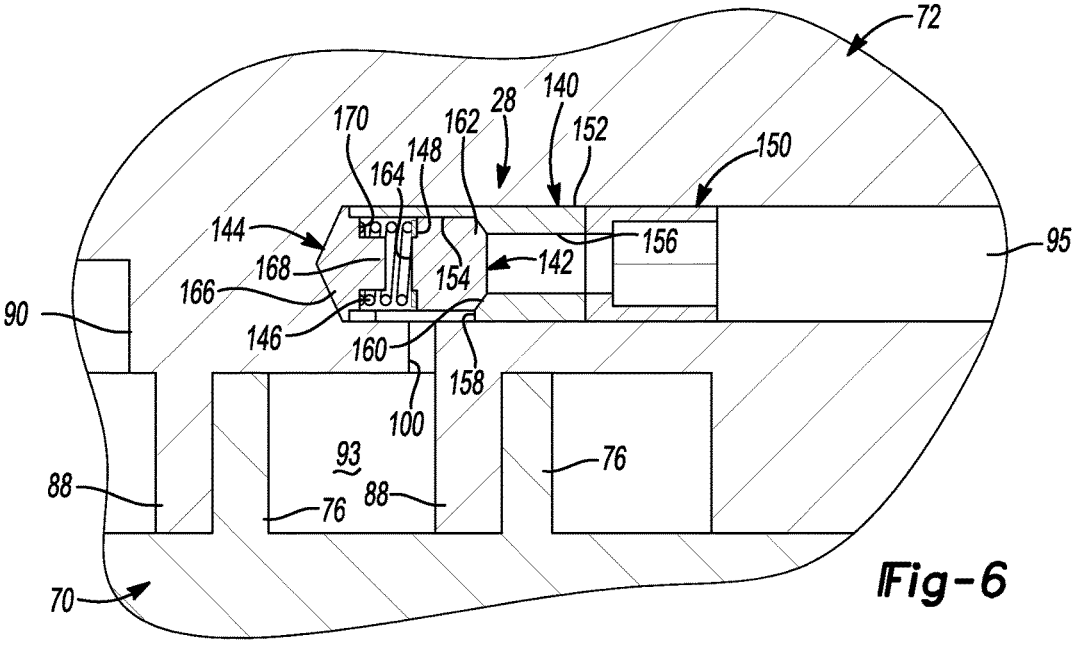
FIG. 6 is a partial cross-sectional view of the non-orbiting scroll member having a fluid-injection valve assembly according to the principles of the present disclosure.

Referring now to FIGS. 2, 6, and 11, the plurality of second valve assemblies 28 may open and close in response to pressure differentials between the fluid pocket 93 and the fluid-injection source 302. When the pressure of the fluid within the fluid pocket 93 and port 100 is less than the pressure of the fluid within the radial bore 94, 95, a net radially inward force (relative to the view shown in FIG. 6) is applied to the valve member 142. When such net radially inward force is sufficient to overcome the biasing force of the compressible member 146, the valve member 142 will move into the open position. When the valve member 142 is in the open position, an intermediate-pressure fluid (i.e., fluid at a pressure higher than suction-pressure but lower than discharge pressure) or a discharge-pressure fluid is allowed to flow from the fluid-injection source 302 into the fluid pocket 93. In the present example, the fluid from the fluid-injection source 302 flows through the fluid-injection fitting 24, 25, through the radial bore 94, 95, into the valve housing 140, around the valve member 142, through the at least one aperture 158, through the fluid-injection port 100 and into the fluid pocket 93.

When the pressure within the fluid pocket 93 rises to a level equal to or above the intermediate-pressure fluid from the fluid-injection source 302, the compressible member 146 cooperates with the fluid pressure between the valve member 142 and the cap 144 to exert a net radially outward force (relative to the view shown in FIG. 6) on the valve member 142 causing the valve member 142 to move into the closed position. In the closed position, the sealed relationship between the valve member 142 and the valve seat 160 prevents communication between the fluid-injection port 100 and the radial bore 94, 95.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A compressor comprising:

a first scroll member including a first scroll wrap extending from a first end plate;

a second scroll member including a second scroll wrap extending from a second end plate, a port, and a passage, said second scroll wrap being intermeshed with said first scroll wrap, said first and second scroll members defining a suction inlet, a discharge outlet and fluid pockets moving between said suction inlet and said discharge outlet, said port being in fluid communication with at least one of said fluid pockets, said passage extending through a portion of said second end plate and in fluid communication with said port and a discharge passage, said discharge passage extending axially through said second end plate and in fluid communication with said discharge outlet, said port disposed radially outward relative to said discharge passage and said discharge outlet;

a valve assembly disposed in said passage and including a valve member displaceable between an open position allowing fluid communication between said port and said discharge passage and a closed position restricting fluid communication between said port and said discharge passage; and a recompression volume disposed within said port between said valve member and said at least one of said pockets, said recompression volume being less than or equal to approximately one percent of a volume of one of said pockets at a suction seal-off position.

2. The compressor of claim 1, wherein said recompression volume is less than or equal to approximately three-hundredths (0.03) percent of said volume of said one of said pockets at said suction seal-off position.

3. The compressor of claim 1, wherein said recompression volume is less than or equal to approximately one-half (0.5) percent of said volume of said one of said pockets at said suction seal-off position.

4. The compressor of claim 1, wherein said valve member includes a first portion slidably engaging said passage and a second portion having a smaller diameter than said first portion and forming a leakage path around said valve member to allow fluid communication between said port and said discharge passage when said valve member is in said open position.

5. The compressor of claim 4, wherein said valve member includes a tapered portion extending into said port when said valve member is in said closed position.

6. The compressor of claim 5, wherein said valve assembly includes a valve body fixed within said passage and a spring disposed axially between said valve body and said valve member and biasing said valve member toward said closed position.

7. A compressor comprising:

a first scroll member including a first scroll wrap extending from a first end plate;

a second scroll member including a second scroll wrap extending from a second end plate, a discharge passage, a port, and an axial passage, said axial passage and said port disposed radially outward relative to said discharge passage, said second scroll wrap being intermeshed with said first scroll wrap, said first and second scroll members defining a suction inlet, a discharge outlet and fluid pockets moving between said suction inlet and said discharge outlet, said discharge passage extending through said second end plate and in communication with said discharge outlet, said port being in fluid communication with at least one of said fluid pockets, said axial passage being in fluid communication with said port and said discharge passage; and a valve member displaceable between open and closed positions and cooperating with said at least one of said pockets to provide a recompression volume that is less than or equal to approximately one percent of a volume of one of said pockets at a suction seal-off position, said recompression volume disposed within said port.

8. The compressor of claim 7, wherein said valve member includes a tip portion, a first outer portion slidably engaging said axial passage, and a second outer portion disposed between said tip portion and said first outer portion, said second outer portion having a smaller diameter than said first outer portion and forming a leakage path around said valve member to allow fluid communication between said port and said discharge passage when said valve member is in said open position.

9. The compressor of claim 7, wherein said recompression volume is less than or equal to approximately three-hundredths (0.03) percent of said volume of said one of said fluid pockets at said suction seal-off position.

* * * * *